United States Patent [19]

Dam

[11] Patent Number: 4,553,120

[45] Date of Patent: Nov. 12, 1985

[54] SELF-CENTERING DEFLECTION YOKE ASSEMBLY

[75] Inventor: Robert Dam, Lombard, Ill.

[73] Assignee: Zenith Electronics Corporation, Glenview, Ill.

[21] Appl. No.: 686,316

[22] Filed: Dec. 26, 1984

[51] Int. Cl.[4] ..... H01F 7/00

[52] U.S. Cl. ..... 335/210; 335/213; 313/421

[58] Field of Search ..... 335/210, 213; 313/421, 313/425

[56] References Cited

U.S. PATENT DOCUMENTS 4,451,807 5/1984 McGlashan et al. ..... 335/210
4,471,261 9/1984 Meier et al. ..... 313/340

FOREIGN PATENT DOCUMENTS 0044585 1/1982 European Pat. Off. ..... 335/213

*Primary Examiner*—George Harris
*Attorney, Agent, or Firm*—Cornelius J. O'Connor; Thomas E. Hill

[57] ABSTRACT

An electron beam deflection yoke for use in a cathode ray tube (CRT) includes a plastic housing within which are symmetrically positioned a pair of horizontal coils and on the outside of which are symmetrically mounted a pair of vertical coils wound on respective halves of a cracked ferrite core. Integral with and on the outside of the housing, or yoke liner, are two pairs of flexible members, or ribs, aligned with the longitudinal axis of the housing, positioned 180° from each other around the circular circumference of the housing, and adapted to engage an inner surface of a respective one-half ferrite core between the coil windings thereon. The flexible ribs are adapted to receive core elements having a wide range of thicknesses and inner dimensions and to maintain the one-half ferrite cores, which are coupled together and held in position by resilient clips, concentric relative to the longitudinal axis of the housing. In addition to ensuring the concentric positioning of the horizontal and vertical coils, the flexible positioning ribs permit the outer vertical coils to be rotated about the longitudinal axis of the housing so as to align the vertical magnetic field 90° relative to the horizontal magnetic field.

10 Claims, 4 Drawing Figures

SELF-CENTERING DEFLECTION YOKE ASSEMBLY

BACKGROUND OF THE INVENTION

This invention relates generally to the deflection of an electron beam in a cathode ray tube (CRT) and is particularly directed to a self-centering deflection yoke assembly for ensuring proper alignment and orientation between the vertical and horizontal deflection coils therein.

The optimal design of a deflection yoke in a CRT requires that the longitudinal centerline of the vertical windings coincide with the longitudinal centerline of the horizontal windings; i.e., the vertical and horizontal coils must be concentrically positioned relative to one another. In addition, the axis of the magnetic field generated by the vertical coil must be perpendicular to the axis of the field generated by the horizontal coil. This ensures that the deflection of the electron beam is along mutually orthogonal axes. A conventional deflection yoke includes two horizontal windings fixedly positioned within a plastic housing called a yoke liner. A vertical coil, which is wound onto two semi-circular halves of a cracked ferrite core, is assembled around the outer periphery of the yoke liner. An undesirable condition known as mismatch occurs when the vertical coil is not concentric with respect to the horizontal coil resulting in the inability of the deflection yoke to provide proper convergence of the electron beam.

When the vertical and horizontal magnetic axes of the deflection yoke are orthogonal, the amount of current induced in the vertical coil due to the magnetic field generated by the horizontal coil, which is referred to as cross talk, is held to a minimum. If cross talk is not minimized, the yoke will generate a distorted raster. Because of the manner in which the horizontal coil is positioned within the yoke liner, its reproducibility is very good. Thus, the orientation of its magnetic axis is quite consistent and predictable, unlike that of the vertical coil. The axis of the vertical coil's magnetic field is determined by the distribution of the wire wound onto the ferrite core. The wire distribution can vary considerably from one coil to another, even when they are wound by the same automatic winding machine. The chief reason for this variation is the relatively wide dimensional tolerance range of the ferrite core. Cores that are dimensionally acceptable but at opposite ends of the tolerance range will exhibit significantly different magnetic axes. The wide range of ferrite core dimensions encountered arises from the manner in which they are manufactured and the ferrite materials from which they are fabricated. Therefore, a means for minimizing cross talk is essential for high quality yoke production.

There are several ways to control both mismatch and cross talk in a deflection yoke. One approach makes use of a notched core which mates with locating ribs molded on the outer surface of the yoke liner. The vertical coil is thus keyed onto the same concentric position for every yoke. However, "locking" the core in a fixed position eliminates the ability to adjust cross talk to a minimum. Therefore, before winding, the ferrite core is precision ground to effectively reduce its wide tolerance range, thereby improving the reproducibility of the vertical coil. This grinding operation is costly and its effectiveness, in general, is marginal. Another approach involving a grinding process is disclosed in U.S. Pat. No. 4,471,261 to Meier et al which contemplates grinding precision grooves in the outer surface of the core, which grooves can then be used as reference surfaces to align the core halves in the winding machine or to position the core halves around the liner. This latter operation requires a special tool which is not an integral part of the yoke liner.

Another approach for controlling mismatch and cross talk involves the use of an interference fit between the vertical coil and the outer contour of the yoke liner. High points, or upraised areas, are provided in the coil by winding several layers of wire in a given area of the ferrite core. The wire distribution must of course be compatible with the desired magnetic output of the coil. As the coil halves are assembled, the high points contact the liner's contour and cause it to deflect slightly. The resilience of the liner is responsible for maintaining the vertical coil's concentricity. Since the angular orientation of the coil is in no way restrained, cross talk can be minimized by slightly rotating the vertical coil with respect to the yoke liner until the vertical and horizontal magnetic fields are orthogonal.

This interference fit approach imposes relatively tight restrictions upon the physical size of the vertical coil. For example, too much wire can make assembly of the core halves impossible, while to little wire can result in mismatch. Achieving the desired magnetic characteristics within these physical limitations can be a tedious task. In addition, another problem associated with the interference fit approach arises from the fact that the wires of the vertical coil are in direct contact with the yoke liner. Rotation of the vertical coil to minimize cross talk can result in a shifting of the wires which changes the deflection yoke's magnetic characteristics.

A variation of the interference fit approach described above utilizes foam-backed tape which is positioned upon and adheres to the outer surface of the yoke liner. Rather than contacting the liner, the vertical coil deforms the foam which acts to center the coil. However, the foam is generally not resilient enough to maintain the concentric alignment of the horizontal and vertical coils. In addition, the foam tends to resist rotation of the vertical coil in attempting to minimize cross talk and, in the process, can cause coil wires to shift or the foam-back tape itself to pull free from the yoke liner.

Yet another method of eliminating mismatch and minimizing cross talk requires a rather sophisticated piece of automatic equipment capable of sensing the horizontal and vertical coil configuration and, with the aid of a computer, automatically positioning the vertical coil in its optimal orientation. Although this approach can be quite effective in optimally positioning the vertical coil, the computer controlled equipment necessary for its implementation is very expensive.

The present invention is intended to overcome the aformentioned limitations of the prior art by providing a self-centering deflection yoke assembly which provides for the concentric alignment of the vertical and horizontal coils over a wide range of dimensional tolerances of the vertical coil magnetic core while permitting rotational displacement between the vertical and horizontal coils to ensure orthogonal alignment of the their respective magnetic fields. The self-centering delfection yoke assembly of the present invention is easily fabricated and assembled, reliably and accurately magnetically aligned by means of a simple manual adjustment without requiring the use of any tools, and is inexpensive.

OBJECTS OF THE INVENTION

Accordingly, it is an object of the present invention to provide improved electron beam deflection in a CRT.

It is another object of the present invention to provide a deflection yoke assembly which ensures concentric alignment of the horizontal and vertical deflection coils.

Yet another object of the present invention is to minimize cross talk between horizontal and vertical deflection coil in an electron beam deflection yoke.

A further object of the present invention is to provide a self-centering deflection yoke assembly for horizontal and vertical windings in which cross talk between the windings can be minimized by a simple manual adjustment without loss of alignment between the aforementioned windings.

A still further object of the present invention is to provide a deflection yoke capable of accommodating vertical deflection coils having a wide range of magnetic core dimensional tolerances while maintaining concentric alignment between the vertical deflection coils and horizontal deflection coils in the yoke.

Another object of the present invention is to provide compensation for radial tolerances in the dimensions of a ferrite core upon which a deflection coil is wound in a magnetic deflection yoke for an electron beam.

BRIEF DESCRIPTION OF THE DRAWINGS

The appended claims set forth those novel features which characterize the invention. However, the invention itselt, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
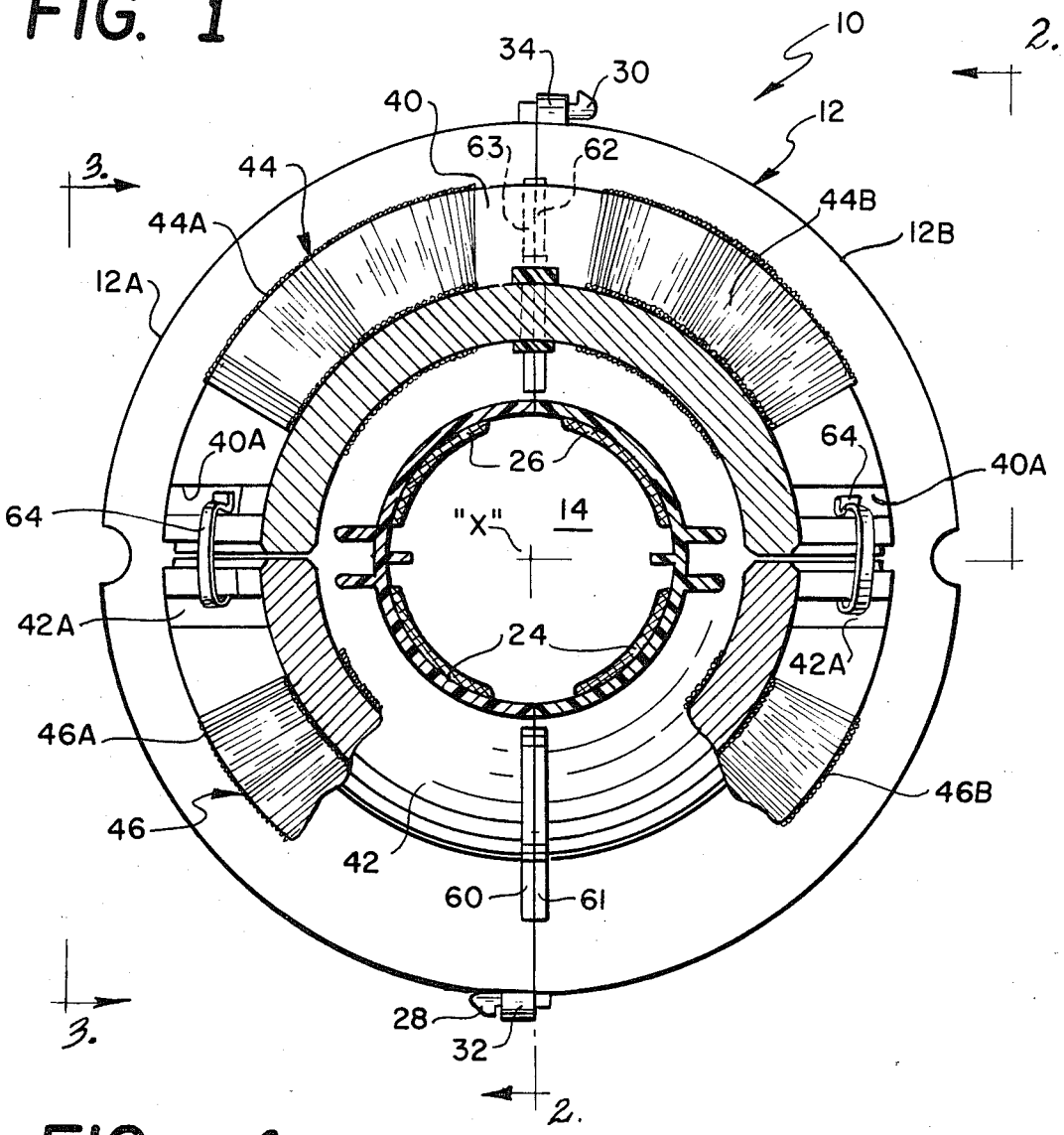
FIG. 1 is a partial elevation and partial cross sectional view of a self-centering deflection yoke assembly in accordance with the present invention taken along sight line 1—1 in FIG. 2.
Figure 2:
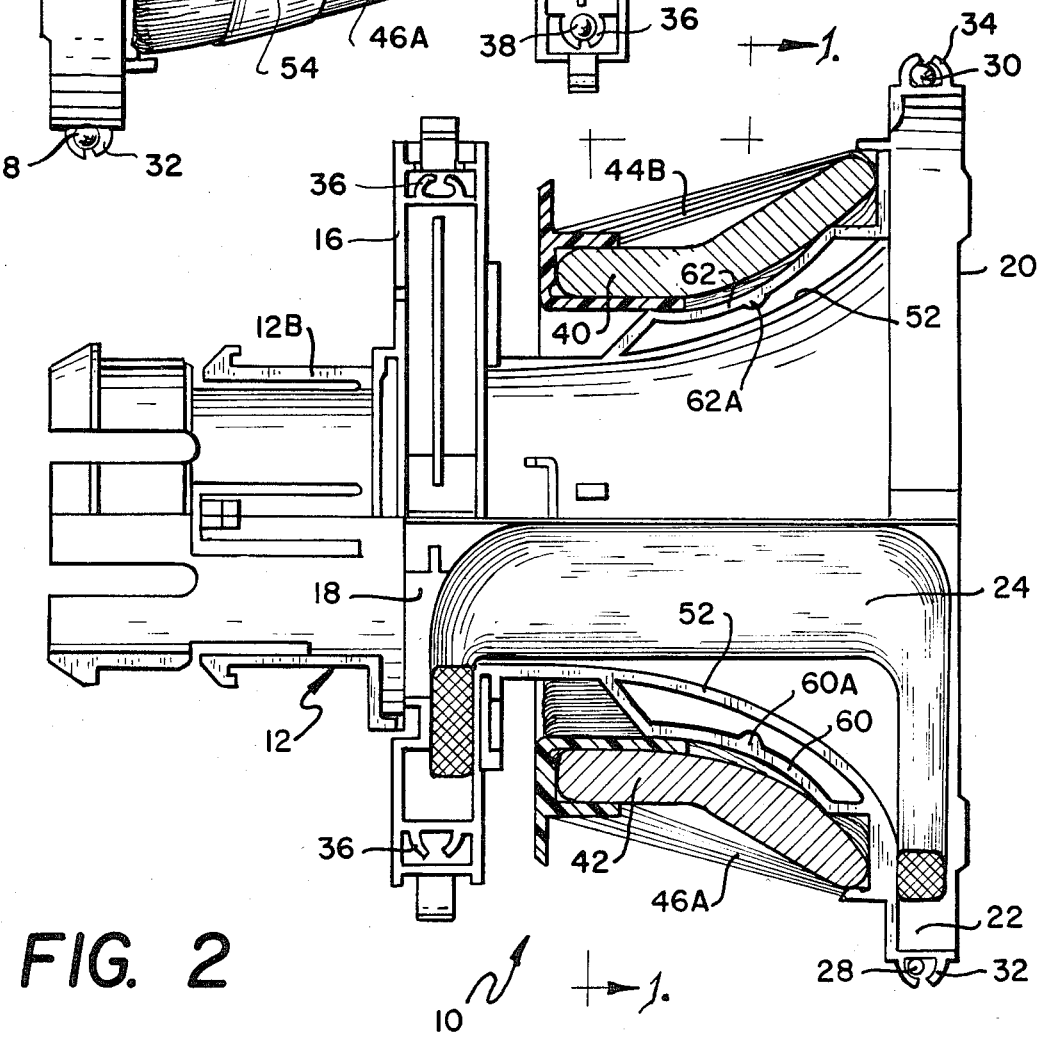
FIG. 2 is a partial elevation and partial cross sectional view of the self-centering deflection yoke assembly shown in FIG. 1 taken along sight line 2—2 therein.

Referring to FIGS. 1 and 2, there are shown partial elevation and partial cross sectinal views taken along the indicated sight lines of a self-centering deflection yoke assembly 10 in accordance with the present invention.

The self-centering deflection yoke assembly 10 is comprised of a yoke housing, or liner, 12 which is preferably comprised of a molded plastic and includes first and second symmetrical housing sections 12A and 12B. Each section forms one half of the yoke liner 12 along the longitudinal axis thereof which is designated by the letter "X" in FIG. 1. The first and second housing sections 12A, 12B are identical and thus form mirror images of each other and when joined form an elongated structure having a generally circular cross section which varies along its length and includes a center aperture 14 extending the length thereof. The first and second housing sections 12A, 12B are adapted to be positioned in abutting contact with each other along a planar section thereof and are maintained in a coupled configuration by means of four separate connection points. Two of the connection points between the first and second housing sections 12A, 12B are on an expanded end portion 20 of this combination and are comprised of clasps 32 and 34 and coupling inserts 28 and 30. Coupling inserts 28 and 30 are respectively mounted to the second and first housing sections 12B, 12A and are adapted for respective insertion within clasps 32 and 34 which are respectively mounted to the first and second housing sections. Each clasp is generally comprised of a pair of inwardly directed fingers between which the coupling insert is positioned and engaged in securely coupling the expanded end portions of the first and second housing sections 12A, 12B. The expanded end portion 20 of the yoke liner 12 in combination with its tapered section 52 adjacent thereto provides the yoke liner with a generally bell-shaped profile as can be seen in FIG. 2. Two additional connection points between the first and second yoke housing sections 12A, 12B are provided for adjacent to an expanded intermediate portion 16 of the yoke liner 12 by a pair of clasp 36 and coupling insert 38 combinations shown in FIGS. 2 and 3.

In addition to its expanded end portion 20, the yoke liner 12 includes an expanded intermediate portion 16. The expanded end and intermediate portions 20, 16 of the yoke liner 12 respectively form annular end and intermediate chambers 22, 18 on the inner surface of the yoke liner. Each of the annular intermediate and end chambers 18, 22 is adapted to receive a portion of a respective horizontal coil, or winding, for securely maintaining the horizontal coils in position within the yoke liner 12. First and second horizontal coils 24, 26, in combination, extend substantially around the circumference of the inner surface of the yoke liner 12 and are symmetrically positioned about its longitudinal axis. In addition, since each of the first and second horizontal coils 24, 26 are positioned within the annular intermediate and end chambers 18, 22 of the yoke liner 12, they extend along a substantial portion of the length of the yoke liner. The configuration and shape of the first and second horizontal coils 24, 26 is such as to provide a first magnetic field for deflecting an electron beam transiting through the center aperture 14 along the length thereof in a horizontal direction relative to the faceplate of a CRT (not shown) which with the self-centering deflection yoke assembly 10 of the present invention is used.

Figure 4:
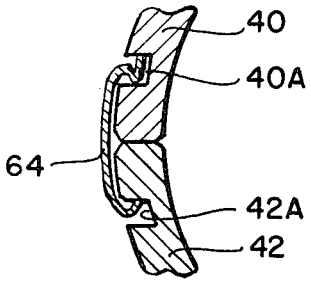
FIG. 4 is a sectional view of a portion of the self-centering deflection yoke assembly of FIG. 3 taken along sight line 3—3 illustrating the coupling arrangement between the semi-circular ferrite core sections therein.
Figure 3:
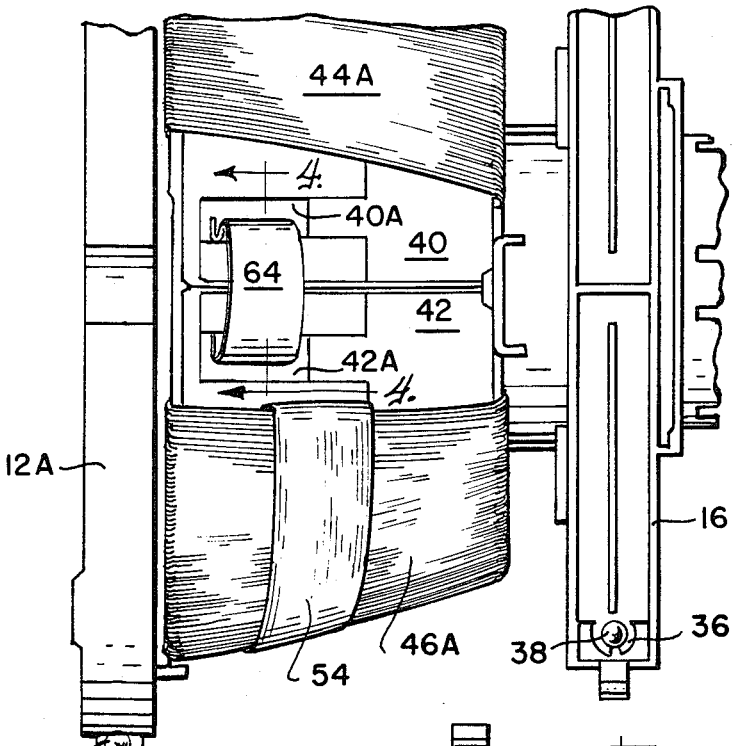
FIG. 3 is a partial lateral view of the self-centering deflection yoke assembly of FIG. 1 taken along sight line 3—3 therein.

The yoke liner 12 gradually tapers outward in proceeding from its expanded intermediate portion 16 toward its expanded end portion 20. This tapered section of the yoke liner 12 is generally circular in cross section and is designated by element number 52 in FIG. 2. Positioned around the circumference of the tapered section 52 of the yoke liner 12 are first and second ferrite cores 40, 42. The first and second ferrite cores 40, 42 are generally semi-circular in cross section and are comprised of a material having high magnetic permeability such as powdered iron (ferrite) of a ceramic material. The inner and outer surfaces of each of the first and second ferrite cores 40, 42 are tapered outwardly in proceeding toward the expanded end portion 20 of the yoke liner 12 in a manner similar to the configuration of the tapered section 52 of the yoke liner. When positioned in tight fitting relation around the circumference of the tapered section 52 of the yoke liner 12, the respective ends of the first and second ferrite cores 40, 42 are positioned in abutting contact so as to form an annular ferrite core around the entireC circumference of the yoke liner. The first and second ferrite cores 40, 42 are each provided with a respective pair of recessed portions 40A, 42A immediately adjacent each end thereof. When the ferrite cores are positioned in tight fitting relation around the circumference of the yoke liner 12 immediately adjacent to the tapered section 52 thereof, each recessed portion 40A of the first ferrite core 40 is positioned adjacent to a corresponding recessed portion 42A of the second ferrite core 42. As shown in FIGS. 3 and 4, respective ends of resilient coupling, or spring, clips 64 are inserted within the recessed portions 40A, 42A of the first and second ferrite cores 40, 42 for securely coupling the two ferrite core sections and maintaining the thus coupled sections firmly in position about the circumference of the tapered section 52 of the yoke liner 12. Each spring clip 64 is snapped into position with its respective ends engaging the recessed portions 40A, 42A of the first and second ferrite cores 40, 42.

Respectively wound around the first and second ferrite cores 40, 42 are first and second vertical coils 44 and 46 as shown in FIGS. 1, 2 and 3. Each of the first and second vertical coils 44, 46 is not wound around the entire length of a respective ferrite core, but rather forms two coil sections about a respective ferrite core. Thus, the first vertical coil 44 is shown positioned upon the first ferrite core 40 in the form of vertical coil sections 44A and 44B. Similarly, the second vertical coil 46 is shown positioned upon the second ferrite core 42 in the form of vertical coil sections 46A and 46B. It is to be noted here that the respective end and center portions of each ferrite core is not covered by the windings of one of the vertical coils. A strip of tape 54, typically of the glass cloth type, is shown in FIG. 3 positioned upon the vertical coil section 46A for maintaining the windings in position.

Positioned adjacent to the respective end portions and on the outer surface of the tapered portion 52 of the first yoke housing section 12A are flexible members, or ribs 60, 63. Similarly, positioned adjacent to the respective end portions and on the outer surface of the tapered portion of the second yoke housing section 12B are flexible members, or ribs, 61 and 62. Each of the flexible ribs extends outward from a respective tapered portion of the yoke liner 12 so as to present a generally concave, resilient surface for receiving a complementary convex, inner portion of a ferrite core.

Each of the flexible, resilient ribs is molded as part of a respective yoke housing section and is thus integral therewith in a preferred embodiment. The profile of the flexible ribs is slightly larger than the inner contour of a ferrite core with maximum allowable dimensions, or thickness, with each pair of adjacent flexible ribs engaging an inner surface of a respective ferrite core in an area where the winding of a vertical coil is not located as shown in the figures. Each of the flexible ribs, which in a preferred embodiment are approximately 0.05" wide, are positioned on the outer surface of the tapered portion 52 of the yoke liner 12 so as to coincide with a clear (unwound) portion of a respective ferrite core. As the first and second semicircular ferrite cores 40, 42 are fit around the outer circumference of the yoke liner 12, each ferrite core encounters a respective pair of flexible ribs which deflect sufficiently to permit assembly of the ferrite core halves. A ferrite core possessing maximum inner dimensions across a diameter thereof will cause the flexible ribs to deflect inward only slightly toward the yoke liner 12. On the other hand, a ferrite core combination having a minimum inner diameter measurement will cause the flexible ribs to deflect inwardly toward the yoke liner 12 to a greater extent. Once assembled, the resilient, flexible ribs 60, 61 and 62, 63 serve to maintain the first and second ferrite cores 40, 42 concentrically aligned relative to the longitudinal axis "X", of the yoke liner 12 with which the first and second horizontal coils 24, 26 are also concentrically aligned. Each of the resilient ribs includes a knob portion along the length thereof shown as elements 60A and 62A for resilient ribs 60 and 62, respectively, in FIG. 2. Each knob portion of a respective resilient rib extends toward and contacts the tapered portion 52 of the yoke liner 12 when the resilient rib "bottoms out" in response to the positioning thereon of a ferrite core having a minimum inner diameter. The knob portions on each resilient rib thus serve to ensure the concentric positioning of a ferrite core having an inner diameter of minimum dimensional tolerance upon the yoke liner.

Although the first and second ferrite cores 40, 42 are securely maintained in position upon the yoke liner 12 by means of the spring clips 64, the combination of the ferrite cores may be rotationally displaced about the longitudinal axis "X" of the yoke liner in minimizing cross talk between the horizontal and vertical coils. By slightly rotating the first and second ferrite cores 40, 42 upon which are respectively wound the first and second vertical coils 44, 46, the vertical and horizontal magnetic fields may be oriented orthogonally relative to one another in eliminating cross talk therebetween. Since each of the flexible ribs contacts the smooth inner contour of a respective ferrite core rather than the coils wound around the core, there is very little resistance to making the rotational cross talk adjustment. In addition, there is virtually no risk of disturbing the coil's winding distribution about either of the ferrite cores and changing the magnetic characteristics of the yoke assembly. Even after this rotational cross talk adjustment is made, the flexible ribs exhibit sufficient strength and resilience to maintain concentricity between the horizontal deflection coils 24, 26 and the vertical deflection coils 44, 46.

There has thus been shown a self-centering deflection yoke assembly which ensures concentric alignment between horizontal and vertical deflection windings thereon over a wide range of dimensional tolerances in a ferrite core upon which the vertical deflection coil is wound. In addition, orthogonal alignment between the magnetic fields of the horizontal and vertical deflection coils is made possible by means of a simple manual adjustment to the vertical deflection coil ferrite core without disturbing the concentric alignment of the horizontal and vertical deflection coils along the longitudinal axis of the self-centering deflection yoke assembly.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true sprirt and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A self-centering magnetic deflection yoke assembly for use with a cathode ray tube comprising:

an annular housing symmetrical about a longitudinal axis and including inner recessed portions and an outer tapered portion;

a horizontal deflection coil symmetrically aligned about the longitudinal axis of the annular housing and positioned within the inner recessed portions thereof;

an annular magnetic core positioned about the outer tapered portion of the annular housing;

a vertical deflection coil symmetrically wound around portions of said magnetic core; and a plurality of spaced, resilient members positioned on the outer tapered portion of said annular housing and in contact with portions of an inner surface of said magnetic core around which said vertical deflection coil is not wound for compensating for variations in the dimensions of said magnetic core in maintaining radial alignment between said magnetic core and the longitudinal axis of said housing and for permitting rotational displacement of the combination of said magnetic core and said vertical deflection coil relative to said horizontal deflection coil.

2. A self-centering magnetic deflection yoke assembly as in claim 1 wherein said annular housing is comprised of molded plastic and said resilient members are integrally molded with said annular housing.

3. A self-centering magnetic deflection yoke assembly as in claim 2 wherein said resilient members are each comprised of a flexible rib attached at respective ends thereof to said housing and extending generally parallel to the outer tapered portion of said housing.

4. A self-centering magnetic deflection yoke assembly as in claim 3 wherein each flexible rib includes displacement limiting means positioned on an inner portion thereof for engaging the tapered portion of said housing in response to the positioning of a magnetic core having an inner diameter of minimal dimensional tolerance for maintaining said magnetic core in radial alignment with the longitudinal axis of said housing.

5. A self-centering magnetic deflection yoke assembly as in claim 1 wherein said resilient members are each comprised of an elongated rib aligned with the longitudinal axis of said annular housing and contoured generally parallel to the outer tapered portion of said annular housing.

6. A self-centering magnetic deflection yoke assembly as in claim 1 wherein said housing is comprised of first and second symmetrical, generally semi-circular sections joined along abutting edge portions thereof and said magnetic core is comprised of a pair of generally semi-circular sections positioned in abutting contact at respective ends thereof.

7. A self-centering magnetic deflection yoke assembly as in claim 6 wherein said vertical deflection coil is not wound around the center and end portions of the generally semi-circular magnetic core sections and wherein said resilient members are in contact with a respective center portion of each of the magnetic core sections.

8. A self-centering magnetic deflection yoke assembly as in claim 6 further comprising coupling means for connecting said semi-circular magnetic core sections to each other at respective ends thereof.

9. A self-centering magnetic deflection yoke assembly as in claim 8 wherein said coupling means includes a pair of resilient spring clips attached to respective abutting edge portions of said semi-circular magnetic core sections.

10. A self-centering magnetic deflection yoke assembly as in claim 1 wherein said magnetic core is comprised of a material having a high magnetic permeability.

* * * * *